US007008170B2

(12) United States Patent
Proveaux et al.

(10) Patent No.: US 7,008,170 B2
(45) Date of Patent: Mar. 7, 2006

(54) COMPRESSOR DIAPHRAGM WITH AXIAL PRELOAD

(75) Inventors: Sanford B. Proveaux, Singer Island, FL (US); Edwin L. Kite, Stuart, FL (US)

(73) Assignee: Siemens Westinghouse Power Corporation, Orlando, FL (US)

( * ) Notice: Subject to any disclaimer, the term of this patent is extended or adjusted under 35 U.S.C. 154(b) by 117 days.

(21) Appl. No.: 10/811,257

(22) Filed: Mar. 26, 2004

(65) Prior Publication Data

US 2005/0214116 A1 Sep. 29, 2005

(51) Int. Cl.
*F01D 25/24* (2006.01)

(52) U.S. Cl. ..... 415/1; 415/209.2; 415/213.1

(58) Field of Classification Search ..... 415/1, 415/209.2, 209.3, 209.4, 210.1, 213.1
See application file for complete search history.

(56) References Cited

U.S. PATENT DOCUMENTS

| | | | | |
|---|---|---|---|---|
| 1,998,951 A | | 4/1935 | Downer | |
| 2,143,467 A | | 1/1939 | Allard | |
| 3,026,087 A | * | 3/1962 | Welsh | 415/209.2 |
| 3,619,077 A | | 11/1971 | Wile et al. | |
| 3,752,600 A | | 8/1973 | Walsh et al. | |
| 4,130,375 A | | 12/1978 | Korta | |
| 4,393,896 A | | 7/1983 | Slabaugh | |
| 4,531,372 A | | 7/1985 | Slabaugh | |
| 4,890,978 A | | 1/1990 | McLaurin et al. | |
| 5,074,752 A | | 12/1991 | Murphy et al. | |
| 5,333,995 A | | 8/1994 | Jacobs et al. | |
| 5,380,157 A | | 1/1995 | Shaffer | |
| 5,459,995 A | | 10/1995 | Norton et al. | |
| 5,487,642 A | | 1/1996 | Norton et al. | |
| 5,554,001 A | | 9/1996 | Boyd et al. | |
| 5,591,003 A | | 1/1997 | Boyd et al. | |
| 5,616,001 A | | 4/1997 | Boyd | |
| 5,681,142 A | | 10/1997 | Lewis | |
| 5,921,749 A | | 7/1999 | McLaurin et al. | |
| 6,000,906 A | | 12/1999 | Draskovich | |
| 6,234,750 B1 | * | 5/2001 | Mielke et al. | 415/189 |
| 6,513,781 B1 | * | 2/2003 | Meyer et al. | 248/544 |
| 2003/0231957 A1 | | 12/2003 | Anderson et al. | |

FOREIGN PATENT DOCUMENTS

JP 63263273 A2 10/1988

* cited by examiner

*Primary Examiner*—Ninh H. Nguyen

(57) ABSTRACT

Aspects of the invention relate to a system for reducing relative movement between the outer shroud of a compressor diaphragm and the compressor cylinder of a turbine engine, thereby minimizing the wearing of these parts. Embodiments of the invention include a system for applying an axial preload on the outer shroud of a compressor diaphragm, preferably in the same direction as the gas load in the compressor. The system can be installed at or near the horizontal joint such that the axial preload can be applied substantially at the horizontal joint, which is the location of the largest relative movement. In one embodiment, the axial preload system can include a two-piece wedge block and pin. As the pin is driven between the two wedge blocks, the force applied to the pin can be converted to an axial load by the spreading apart of the two wedge block sections.

20 Claims, 10 Drawing Sheets

FIG. 4

COMPRESSOR DIAPHRAGM WITH AXIAL PRELOAD

FIELD OF THE INVENTION

The invention relates in general to turbine engines and, more particularly, to a system for minimizing compressor diaphragm wear.

BACKGROUND OF THE INVENTION

As shown in FIG. 1, the compressor section 10 of a turbine engine can be housed within a compressor outer casing, cylinder or shell 12. The casing 12 can be made of two semi-cylindrical halves secured together at a joint 14, known as the horizontal joint 14 because of its substantially horizontal orientation when assembled. The outer casing 12 encloses a rotor (not shown) on which multiple rows of airfoils or blades 16 are mounted. The rows of blades 16 alternate with the rows of stationary airfoils or vanes 18, which can be attached to and extend radially inward from the compressor shell 12. In some instances, the vanes 18 can be provided in the form of a diaphragm 20. Each diaphragm 20 can include inner and outer radial bands 22,24, referred to as shrouds, with a plurality of vanes 18 circumferentially arrayed therebetween. Like the compressor shell 12, the diaphragm 20 can be made of two substantially semi-circular halves.

The diaphragm 20 can be secured to the compressor shell 12 in various ways. For example, as is known in the art, the compressor shell 12 can include a circumferential slot 26 along its inner peripheral surface 28 for receiving the outer shroud 24 so as to mount the diaphragm 20 on the shell 12. Thus, each half of the compressor shell 12 can hold a substantially semi-circular diaphragm 20. Typically, the outer shroud 24 can fit loosely within the slot 26, as shown in FIG. 2. This loose fit allows relative movement between the diaphragm 20 and the cylinder 12, which can occur when subjected to vibration and other forces during compressor operation. However, over time, this relative movement can lead to wear on the interfacing surfaces of these parts. One area of particular concern is at or near the horizontal joint 14 because the largest relative motion occurs at the free ends of the diaphragm 20. Experience has shown that cracks can develop in the outer shroud 24 at or near the horizontal joint 14 as well as in the inner shroud 22.

There have been prior attempts to reduce the relative movement between these parts and thereby slow the resulting wear. For instance, one approach involves filling the space between the outer shroud and the slot with a packing material, such as a flexible filler. However, the packing material merely fills the gap without exerting any force on the outer shroud of the diaphragm. Eventually, the filler material will wear away.

Another previous system includes the use of cam-type mechanisms. While the cam-type devices can apply an axial load on the shroud, the load is applied at some distance from the horizontal joint 14. Therefore, the cam-type system fails to address the large relative movement near the horizontal joint 14. Further, the cam-type devices are installed through a radial penetration in the compressor cylinder, which presents the additional challenge of sealing such a penetration.

Thus, there is a need for a system for reducing the play between and, ultimately, the wearing of the compressor diaphragm and the compressor cylinder. Ideally, such a system would avoid penetration of the compressor cylinder.

In addition, the system should address the known problem areas at or near the horizontal joint.

SUMMARY OF THE INVENTION

Aspects according to embodiments of the invention relate to a system for reducing wear on a compressor diaphragm. The system includes a substantially semi-cylindrical compressor shell, a diaphragm and a load applying member. The shell has a radially outer peripheral surface, a radially inner peripheral surface, two circumferential ends, an axial upstream end and an axial downstream end. The shell also includes a slot extending along the radially inner peripheral surface from one circumferential end to the other circumferential end. Further, the shell further includes at least one recess located substantially at one of the circumferential ends. The recess opens into the slot in the direction of one of the axial ends of the shell. The circumferential ends can be substantially horizontal.

The diaphragm has an outer shroud with a plurality of airfoils extending radially therefrom. The outer shroud has a forward face and an aft face. The outer shroud is received within the slot in the compressor shell.

The load applying member is disposed within the recess. The load applying member exerts an axial force on one of the faces of the outer shroud in the direction of one of the axial ends of the shell. In one embodiment, the recess can open into the slot toward the axial upstream end of the shell; thus, the load applying member exerts an axial force on the aft face of the outer shroud in the axial upstream direction. Alternatively, the recess can open into the slot toward the axial downstream end of the shell, in which case, the load applying member exerts an axial force on the forward face of the shroud in the axial downstream direction.

The load applying member can be a wedge block. In one embodiment, the wedge block can include an elongated first wedge block and an elongated second wedge block. The first wedge block can have an outer face and a substantially concave inner face. Each face can extend along the length of the first wedge block. The second wedge block can have an outer face and a substantially concave inner face. Each face can extend along the length of the second wedge block. The second wedge block can include a protrusion extending from the at least a portion of the outer face.

The first wedge block can be positioned substantially adjacent to the second block such that the concave inner faces face each other. The concave inner faces can taper toward each other along a portion of the length of the first and second wedge blocks so as to define a tapered region. The tapered region can be a self-holding taper. The recess can be shaped to permit substantially only axial movement of the second wedge block. At least one cutaway is formed in at least one of the inner faces along a portion of the length of at least one of the first and second wedge blocks.

The system can further include a wedge pin. The pin can include a tapered region, wherein the pin is lockingly received between the first and second wedge blocks when the tapered region of the pin engages the tapered region of the first and second wedge blocks.

In other respects, embodiments according to aspects of the invention relate to a wedge block apparatus for applying an axial preload on a compressor diaphragm. The apparatus includes an elongated first wedge block and an elongated second wedge block. The first wedge block has an outer face and a substantially concave inner face; each face extends along the length of the first wedge block. Likewise, the second wedge block has an outer face and a substantially concave inner face. Each face extends along the length of the second wedge block. The second wedge block includes a protrusion extending from at least a portion of the outer face.

The first wedge block is positioned substantially adjacent to the second block such that the concave inner faces face each other. The concave inner faces taper toward each other along a portion of the length of the first and second wedge blocks so as to define a tapered region. The tapered region can be a self-holding taper. In one embodiment, the self-holding taper can be no more than about 6 degrees included. In another embodiment, the self-holding taper can be at least about 6 degrees included.

At least one cutaway is formed in one or both of the inner faces along a portion of the length of at least one of the first and second wedge blocks. The cutaway can be formed substantially in the tapered region. In one embodiment, the first and second wedge blocks can define first and second sidewalls; in such case, the cutaways can be formed in the sidewalls substantially in the tapered region.

The wedge block apparatus can further include a pin. The pin can include an upper region transitioning to a tapered region. The tapered region of the pin can be a self-holding taper. In one embodiment, the self-holding taper can be no more than about 6 degrees included. In another embodiment, the self-holding taper can be at least about 6 degrees included. The pin can be substantially held between the first and second wedge blocks when the tapered region of the pin engages the tapered region of the first and second wedge blocks. Thus, as the pin is driven in between the first and second blocks, the cutaway substantially prevents transmission of the pin load to cause lateral movement of the first and second wedge blocks.

Aspects of the invention also relate to a method for reducing wear on a compressor diaphragm. The method includes the step of providing a substantially semi-cylindrical compressor shell and a diaphragm. The compressor shell has a radially outer peripheral surface, a radially inner peripheral surface, two circumferential ends, an axial upstream end and an axial downstream end. The shell includes a slot extending along the radially inner peripheral surface from one circumferential end to the other circumferential end. In addition, the shell includes at least one recess located substantially at one of the circumferential ends. The diaphragm includes an outer shroud with a plurality of airfoils extending radially therefrom. The outer shroud has a forward face and an aft face. The outer shroud is received within the slot in the compressor shell.

According to the invention, a substantially axial force is applied on one of the faces of the outer shroud in the direction of one of the axial ends of the shell. The force is applied substantially at the horizontal joint at each circumferential end of the compressor shell. In one embodiment, the step of applying a substantially axial force can include providing at least one recess in the shell located substantially at one of the circumferential ends. The recess can open into the slot in the direction of one of the axial ends of the shell. Thus, an axial load applying member can be inserted in the slot such that the member applies an axial load on the outer shroud of the diaphragm.

DETAILED DESCRIPTION OF EMBODIMENTS OF THE INVENTION

Figure 1:
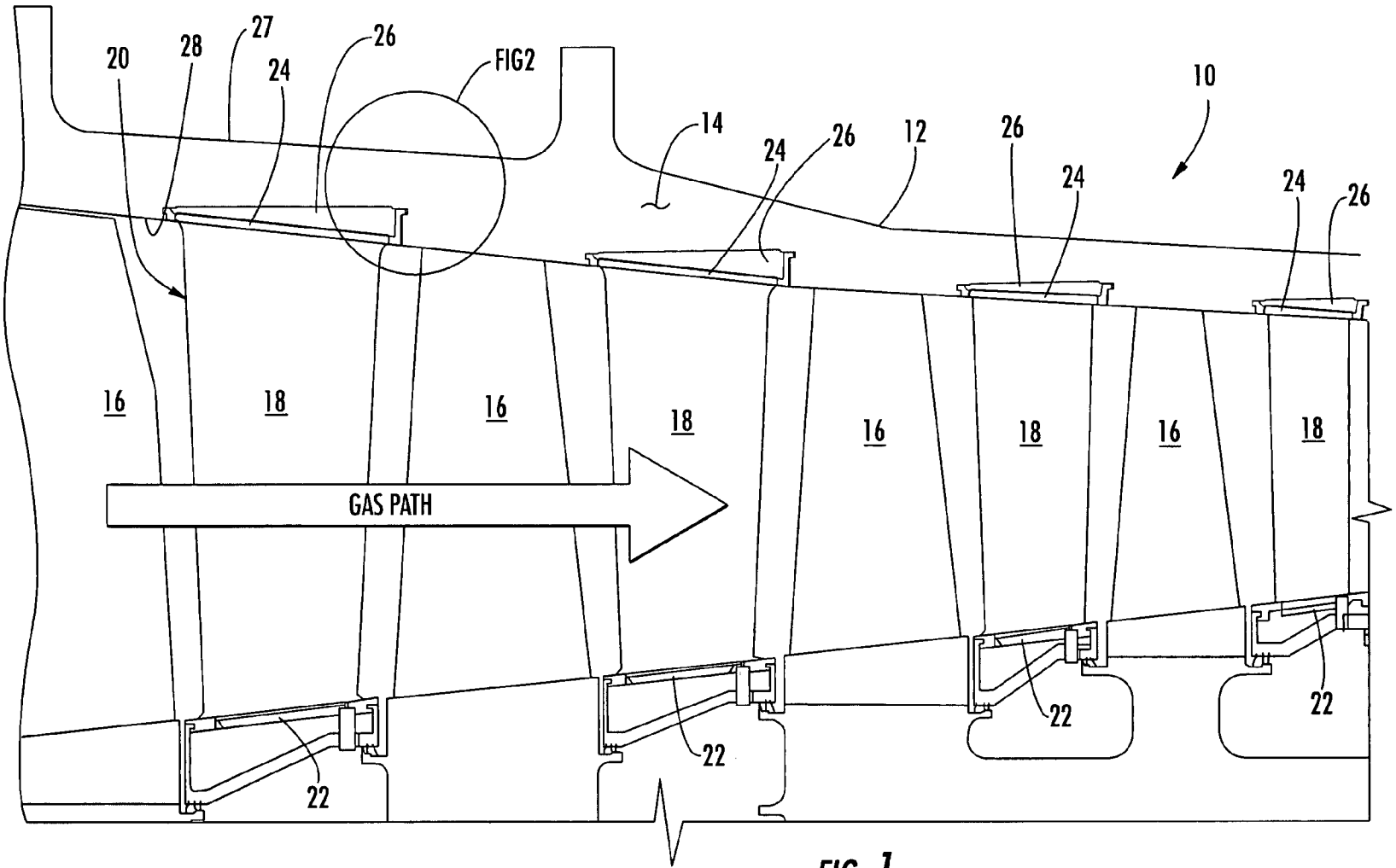
FIG. 1 (PRIOR ART)
FIG. 1 is a top plan view of a portion of a prior compressor for a turbine engine, showing the upper compressor shell removed to reveal the horizontal joint.
Figure 2:
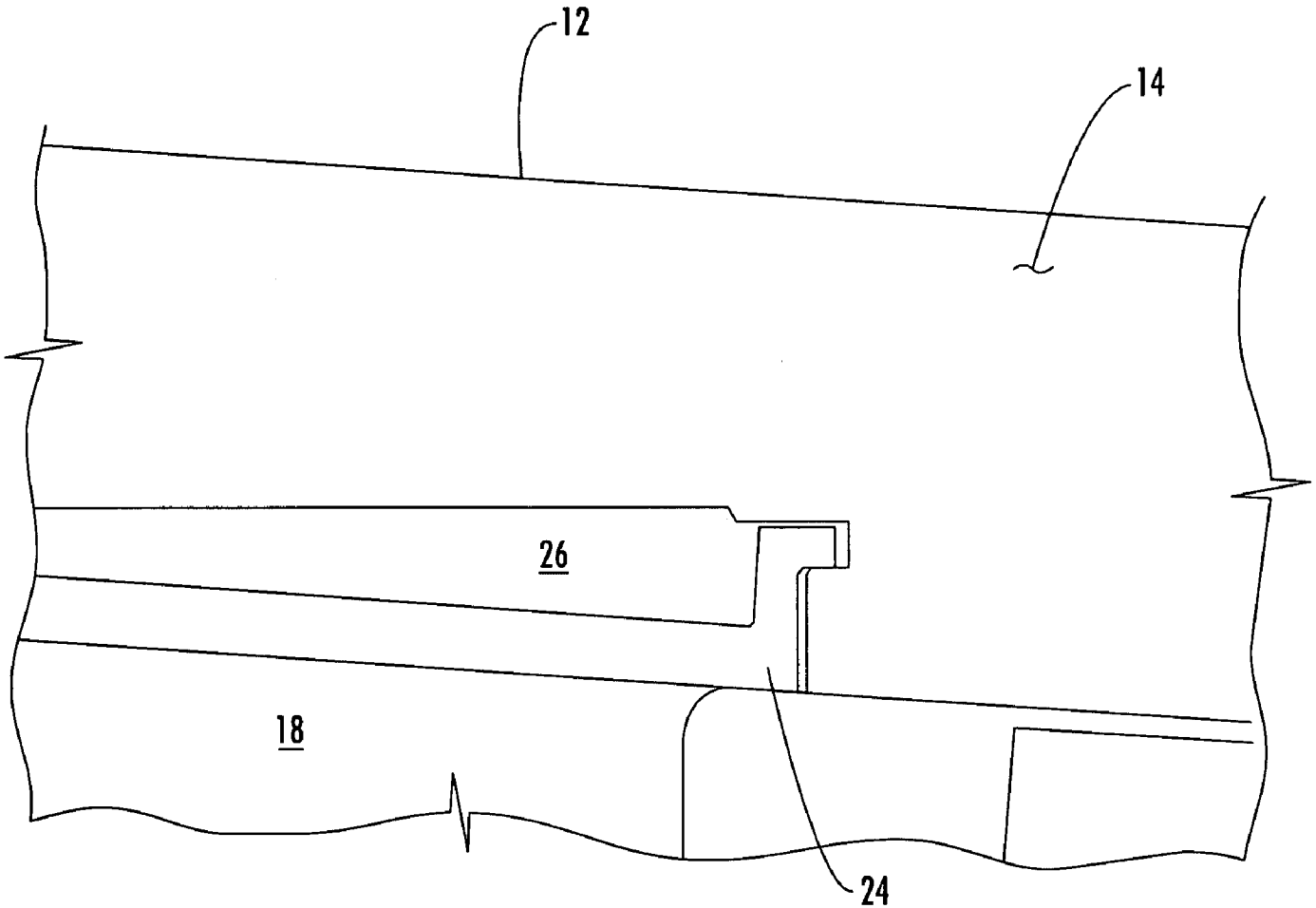
FIG. 2 (PRIOR ART)
FIG. 2 is a close-up view of the prior compressor, showing the compressor diaphragm interface with the slot in the compressor shell, taken at view FIG. 2 in FIG. 1.
Figure 3:
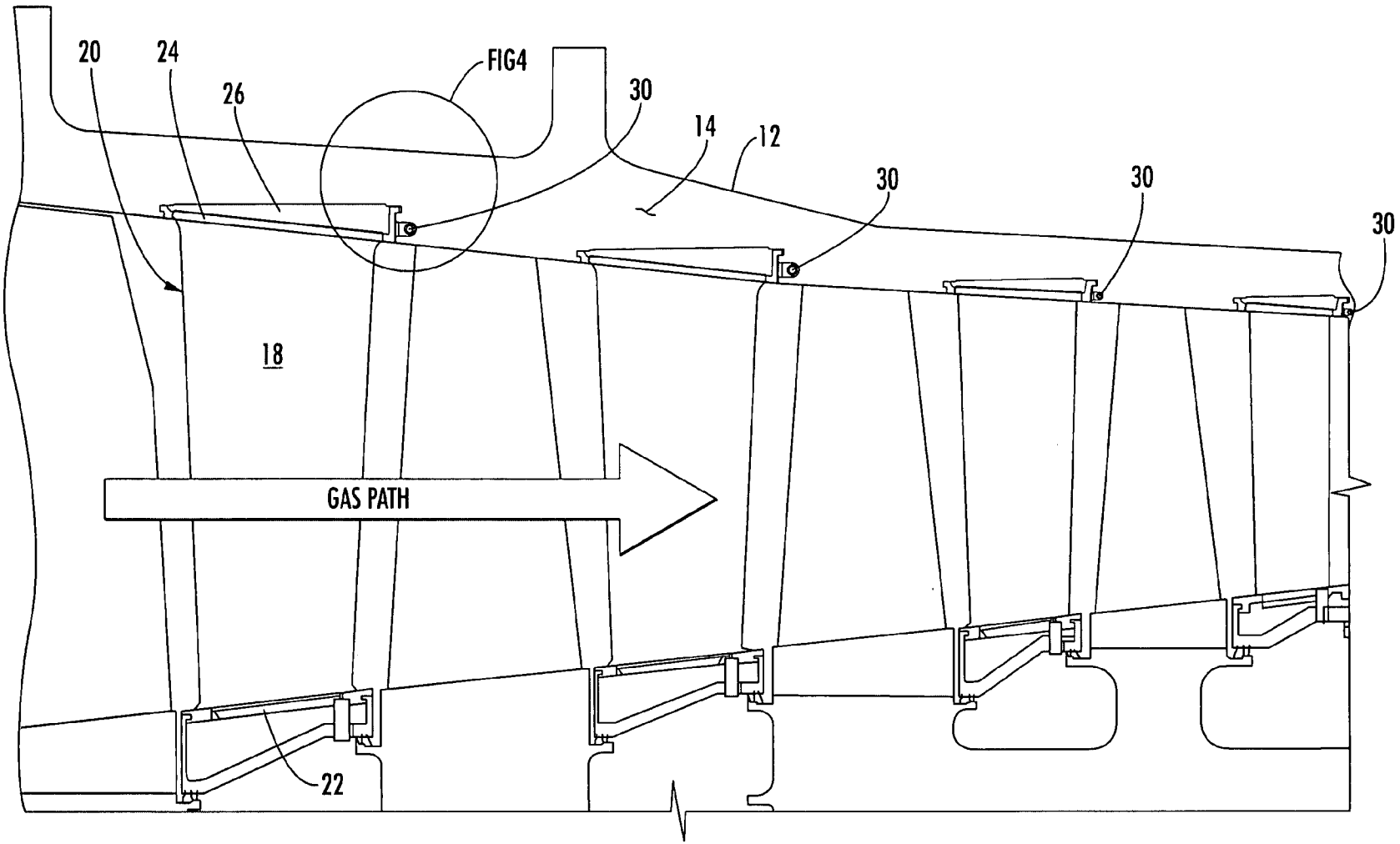
FIG. 3 is a top plan view of a portion of a compressor for a turbine engine according to an embodiment of the invention, showing the upper compressor shell removed to reveal the horizontal joint.

Aspects of the present invention address the shortcomings of earlier efforts to reduce wear on a compressor diaphragm due to its repeated interaction with the slot in the compressor shell. Aspects of the present invention are directed to systems, methods and apparatus for axially preloading a compressor diaphragm at the compressor horizontal joint so as to reduce the amount of relative movement between the diaphragm and shell, thereby minimizing wear and increasing the potential lifespan of such components.

Embodiments of the invention will be explained in the context of one possible compressor system, but the detailed description is intended only as exemplary. Embodiments of the invention are shown in FIGS. 3–10, but the present invention is not limited to the illustrated structure or application.

Diaphragm wear can be minimized according to aspects of the invention by applying an axial preload on the diaphragm 20, particularly at or near the horizontal joint 14. The preload can be exerted by way of an axial load applying member. There are numerous axial load applying members within the scope of the invention. For example, the axial load applying member can be a wedge block. In one embodiment, shown in FIGS. 3 and 4, the axial load applying member can be a multi-part wedge block apparatus 30 including a first wedge block 32, a second wedge block 34 and a wedge pin 36. Each of these components will be discussed in turn below.

Figure 5A:
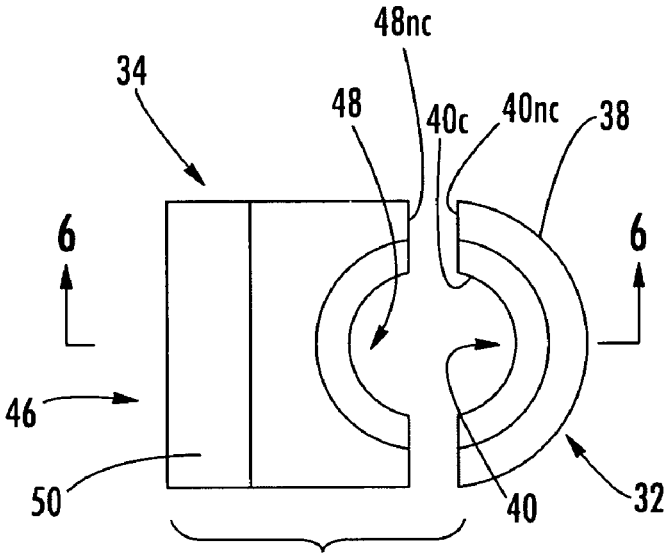
FIG. 5A is a top plan view of a wedge block apparatus according to an embodiment of the invention.
Figure 5B:
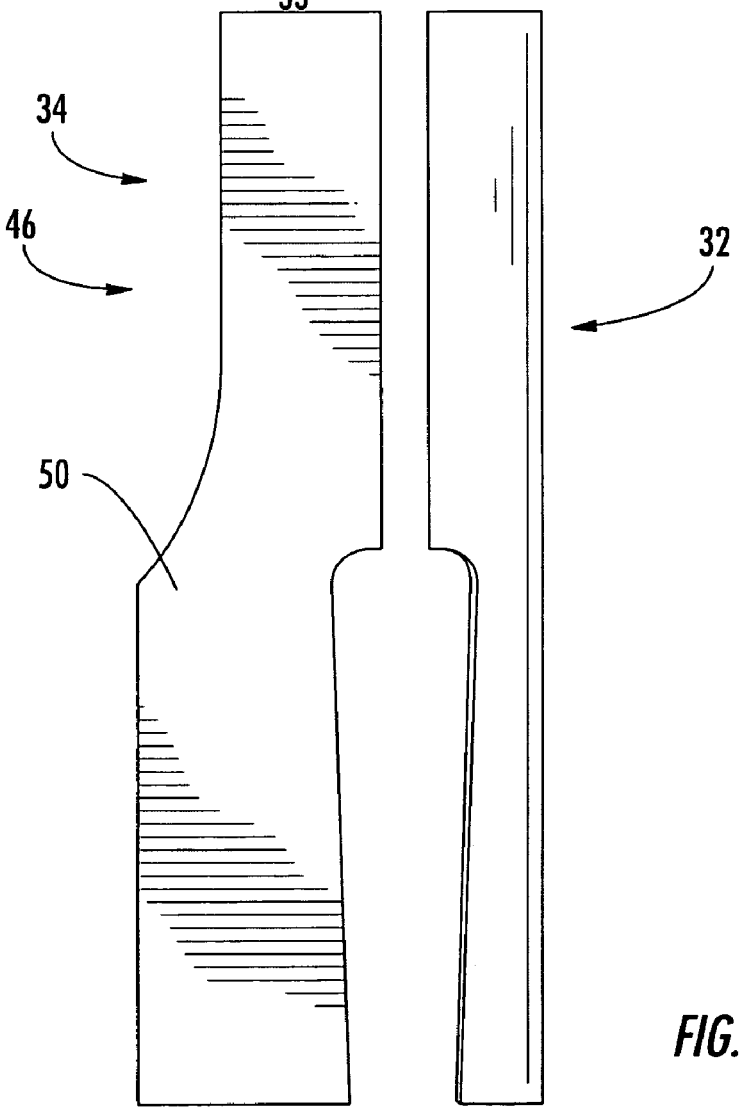
FIG. 5B is a side elevational view of a wedge block apparatus according to an embodiment of the invention.

Referring to FIGS. 5A and 5B, the first wedge block 32 can be generally elongated. The first wedge block 32 can have an outer face 38 and an inner face 40; each face 38,40 can extend along the length of the first wedge block 32. The outer face 38 can have any of a number of conformations, and embodiments of the invention are not limited to any particular configuration. For instance, the outer face 38 can be curved or substantially semi-cylindrical. Alternatively, the outer face 38 can be polygonal, rectangular, or triangular, just to name a few possibilities.

At least a portion of the inner face 40 can be substantially concave 40*c* along the length of the first wedge block 32. Some portions of the inner face 40 may not be concave, such as portions 40*nc* shown in FIG. 5B. Thus, the term "substantially concave," as used herein, is intended to embrace a conformation of the inner face 40 that is concave over substantially its entire area, and further provides for the possibility that the inner face 40 can have non-concave portions including, for example, portions 40*nc*.

Figure 6:
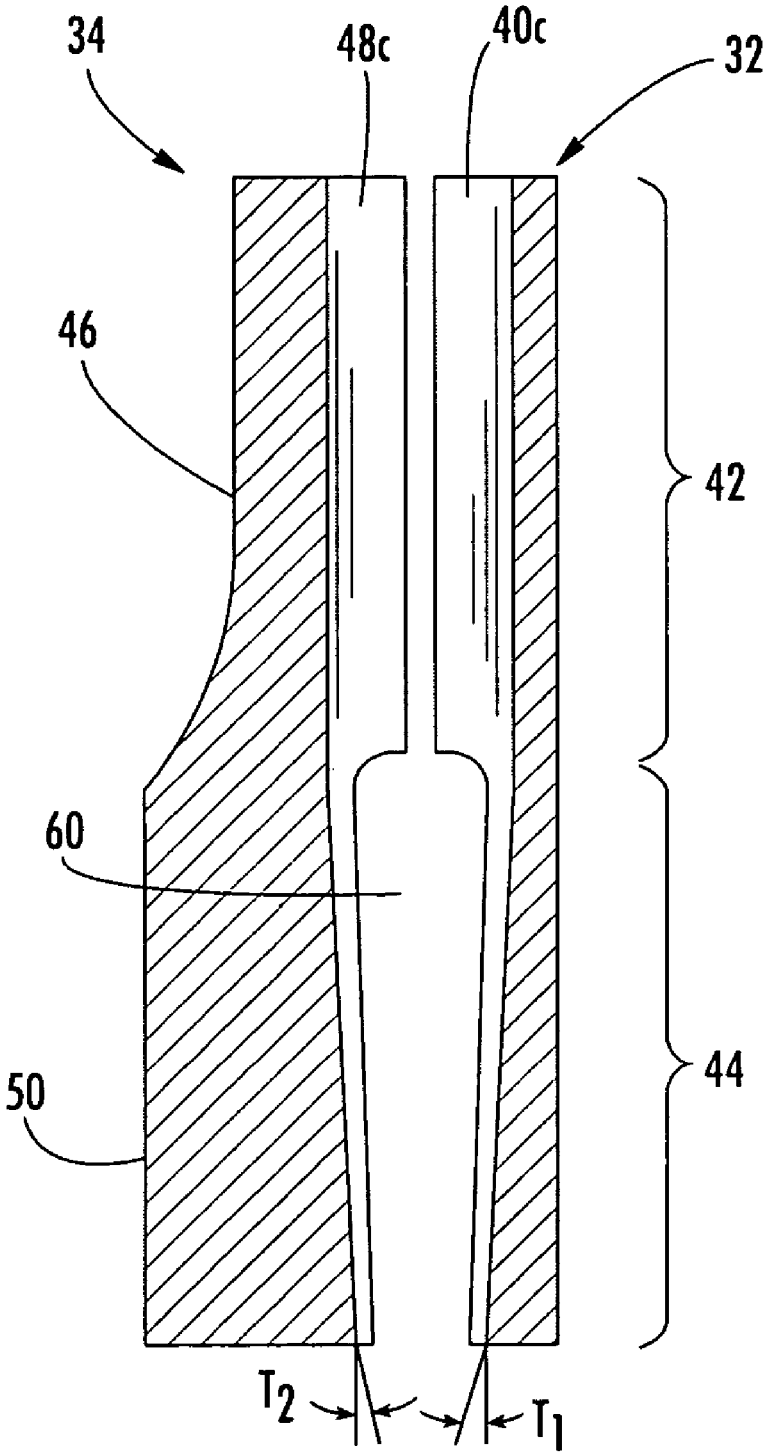
FIG. 6 is a cross-sectional view of a wedge block apparatus according to an embodiment of the invention, taken along line 6—6 in FIG. 5A.

The concave portion 40*c* of the inner face 40 can be semi-cylindrical. While the term "concave" preferably means substantially semi-cylindrical, the term is used herein to include a range of conformations including polygonal, conical, frusto-conical, v-shaped, and rectangular, just to name a few possibilities. In one embodiment, the concave inner face 40*c* can be tapered along a portion of the length of the first wedge block 32. For instance, as shown in FIG. 6, the inner face 40 can be substantially semi-cylindrical at an upper portion 42 and transition to a tapered region at a lower portion 44. It should be noted that the terms, "lower" and "upper" are used merely to facilitate discussion and are not intended to limit the scope of the invention. The taper angle T1 can be at about 3 degrees relative to the semi-cylindrical wall of the upper portion 42. Alternatively, the taper angle T1 can be less than about 3 degrees. The taper angle T1 can be greater than about 3 degrees, depending on the associated coefficient of friction. The larger the coefficient of friction, the steeper the taper angle T1 could be.

The second wedge block 34 can be generally elongated. The second wedge block 34 can have an outer face 46 and an inner face 48; each face 46, 48 can extend along the length of the second wedge block 34. The outer face 46 can have any of a number of forms. For example, as shown in FIG. 5A–5B, the outer face 46 can be generally rectangular. Alternatively, the outer face 46 can be, for example, polygonal or rounded. The second wedge block 34 can include a protrusion 50 extending from at least a portion of the outer face 46. The protrusion 50 can have a variety of forms. For instance, the protrusion 50 can be a generally rectangular pad, as shown in FIGS. 5A–5B. The protrusion 50 can be a single protrusion or it can be two or more protrusions. Preferably, the protrusion 50 is only provided in the lower portion 44 of the second wedge block 34.

At least a portion of the inner face 48 can be substantially concave along the length of the second wedge block 34, but some portions of the inner face 48 may not be concave, such as portion 40*nc* shown in FIG. 5A. The concave inner face 48*c* can be semi-cylindrical. The above discussion of the terms "substantially concave" and "concave" in connection with the first wedge block 32 is equally applicable to the second wedge block 34. In one embodiment, the concave inner face 48*c* can include taper along a portion of the length of the second wedge block 34. For instance, the inner face 48 can be substantially semi-cylindrical at an upper portion 42 and transition to a tapered region at a lower portion 44. The taper angle T2 can be at about 3 degrees relative to the cylindrical wall, preferably being substantially identical to the taper angle T1 of the tapered region of the inner face 40 on the first wedge block 32. The taper angle T2 can be less than about 3 degrees. Depending on the associated coefficient of friction, the taper angle T2 can be more than about 3 degrees; the higher the coefficient of friction, the steeper the taper angle T2 can be. Preferably, the tapered region in each of the first and second wedge blocks 32,34 occurs at substantially the same point along the length of the respective block.

The first wedge block 32 can be positioned substantially adjacent to the second wedge block 34 such that the concave inner faces 40*c*,48*c* face each other so as to be substantially aligned, as shown in FIG. 6. Thus, the concave inner faces 40*c*,48*c* taper toward each other along a portion of the length of the first and second wedge blocks 32,34. As a result, a cavity is formed between the inner faces 40*c*,48*c*. Following the contours of the inner faces 40*c*,48*c*, the cavity transitions from a substantially cylindrical region to a substantially tapered region. The tapered region can preferably be a self-holding taper. For example, when each inner face is tapered at about 3 degrees, the self-holding taper is about 6 degrees included. Other self-holding taper angles are possible including those less than or greater than about 6 degrees included, as will be appreciated by one skilled in the art.

At least one of the first and second wedge blocks 32,34 can have at least one cutaway 60 formed along a portion of the length of the first and second wedge blocks 32,34. In one embodiment, both the first and second wedge blocks 32,34 include a cutaway, as shown in FIG. 5B. In other embodiments, a cutaway 60 may be provided in only one of the wedge blocks 32,34. The cutaway 60 can be formed substantially in the tapered region. In one embodiment, the cutaway 60 can be formed only in the lower portion 44. The first and second wedge blocks 32,34 can define sidewalls 33. Cutaways 60 can be formed in the sidewalls 33, such as substantially in the tapered region. The cutaways 60 can be formed in the inner faces of the first and second wedge block along a portion of the length of the blocks. The cutaways 60 can extend from the inner faces 40,48 to the outer faces 38,46, as shown in FIG. 5B. However, the cutaways 60 need not extend all the way through to the outer faces 38,46.

The first and second wedge blocks 32,34 can be made of any of a variety of materials including various steels, such as 304 stainless steel. Preferably, the material selected is one that is identical or at least compatible with the material of the compressor cylinder 12. Also, it is preferred if the material is one that is relative easy to machine. Materials with magnetic properties may also be desirable at least during installation and service processes.

Because of the cooperating nature of the first and second wedge blocks 32,34 and the substantially aligned tapered regions, it is preferred if the blocks 32,34 are made as a pair from the same raw stock. For example, a stock material can be formed into the desired outer shape and cut to length. The inner faces 40,48 can then be machined as desired. Lastly, the work piece can be cut in half using standard machining processes and tools to form the first and second wedge blocks 32,34. Subsequent operations can be performed as necessary to include any additional desired features, such as the cutaway 60. This is just one of many ways of making the first and second wedge blocks 32,34; many other ways are possible as will be appreciated by one skilled in the art.

Figure 7:
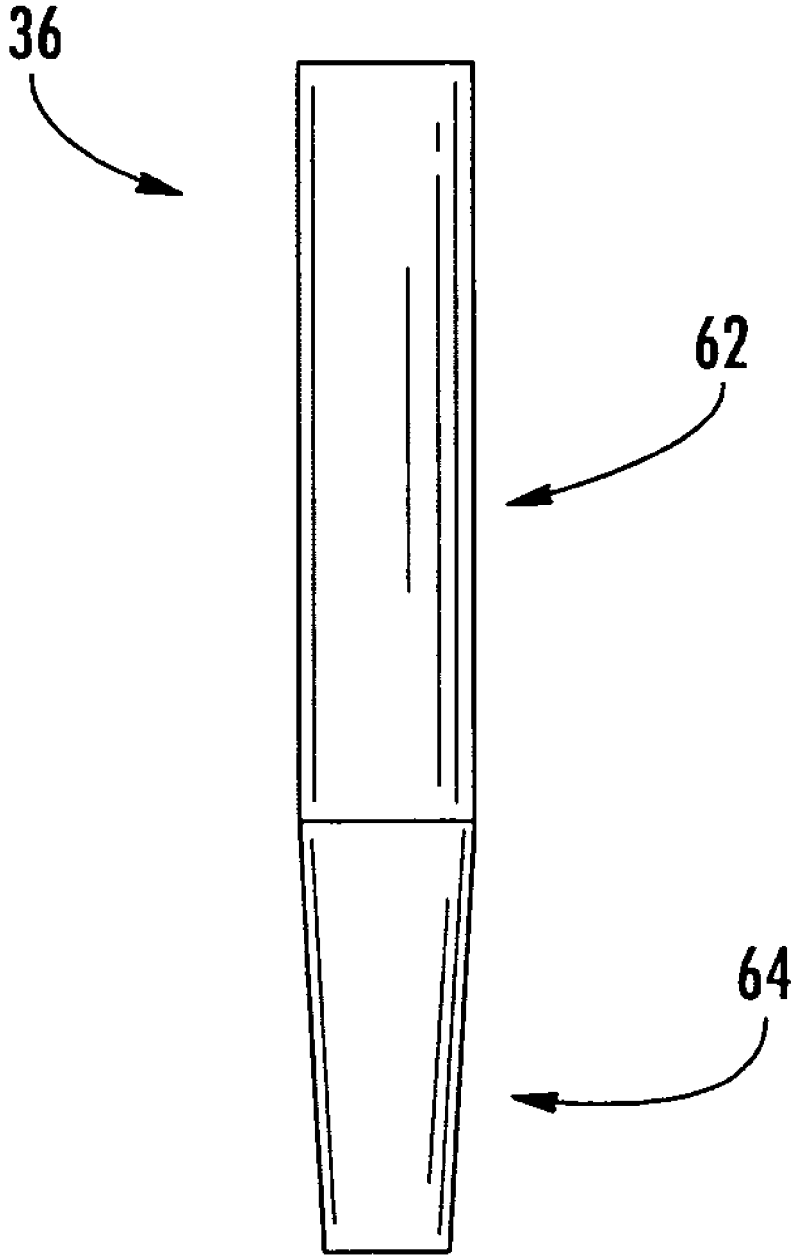
FIG. 7 is a side elevational view of a wedge pin according to an embodiment of the invention.

As noted above, the wedge block system 30 can further include a wedge pin 36. One example of a wedge pin 36 according to embodiments of the invention is shown in FIG. 7. The pin 36 can include an upper region 62 transitioning to a tapered region 64. The upper region 62 can be substantially straight or untapered. Preferably, the upper region 62 is substantially cylindrical in conformation. Alternatively, the upper region 62 can be substantially polygonal, rectangular, triangular, or round in conformation, just to name a few possibilities. The term "upper" is used to facilitate the discussion in connection with FIG. 7 and is not intended to limit the scope of the invention. The tapered region 64 of the pin 36 can be substantially conical or frusto-conical in conformation. However, the pin 36 is not limited to these specific geometries. Preferably, the outer conformation of the pin 36 can substantially correspond to the inner concave faces 40*c*,48*c* of the first and second wedge blocks 32,34, especially in the tapered region 44.

The tapered region 64 of the pin 36 can be a self-holding taper. In one embodiment, the self-holding taper can be less than or equal to about 6 degrees included; in other words, the tapered region 64 is tapered at less than or equal to about 3 degrees. Preferably, the tolerances on the taper are tightly controlled. If the taper is too large, then the pin 36 will not lockingly engage the tapered inner concave faces 40*c*,48*c* of the wedge blocks 32,34; in other words, the pin 36 will move out of engagement with the tapered inner faces 40,48 of the first and second wedge blocks 32,34. On the other hand, if the taper angle is too small, then the amount of axial expansion or separation of the wedge blocks 32,34 will be minimal compared to the amount of pin movement, ultimately encountering space limitations.

The wedge pin 36 can be made of a variety of materials, and it is preferably made of the same material as the first and second wedge blocks 32,34, or, at least compatible with the material of the first and second wedge blocks 32,34 as well as the compressor cylinder 12. Therefore, the above discussion with respect to the materials for the wedge blocks 32,34 applies equally here as well.

Again, the above-described wedge block apparatus 30 is just one example of an axial load applying member according to embodiments of the invention. However, the invention is not limited to the specific axial load applying members discussed above. For instance, embodiments of the invention can include wedge and other types of axial loading systems having greater or fewer individual components. Actually, the axial load applying member can be almost any device so long as it can exert a substantially axial load on the outer shroud 24 of the compressor diaphragm 20 at the horizontal joint 14.

Figure 8:
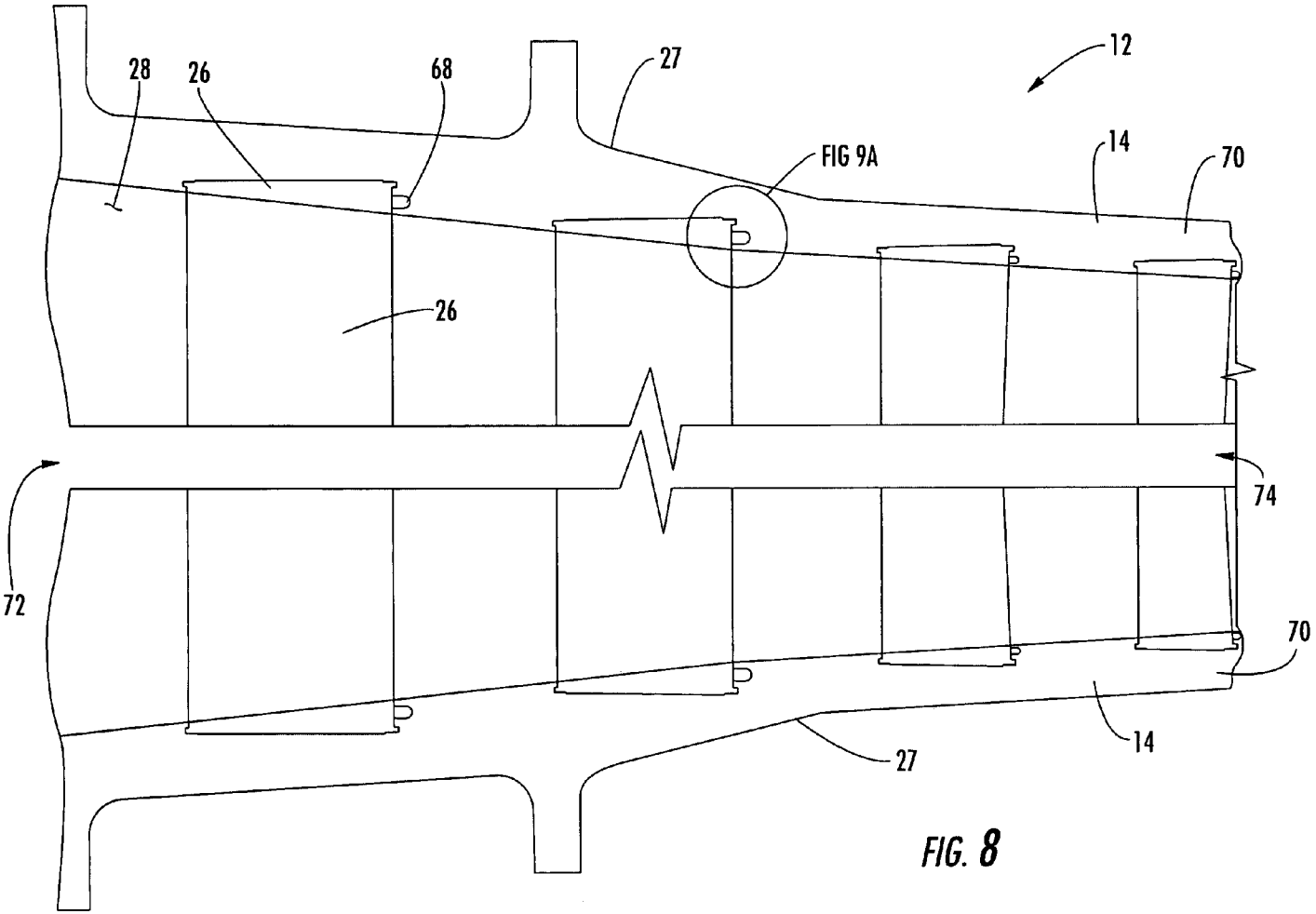
FIG. 8 is a top plan view of a compressor half shell according to an embodiment of the invention, with additional hardware removed for purposes of clarity.

The inclusion of an axial load applying member to a compressor 10 may require modification or alteration to the existing compressor shell 12. Specifically, a recess 68 (FIG. 4) may need to be provided in the compressor shell 12. To facilitate discussion of the recess 68, additional features of the compressor shell 12 will be mentioned at this time, referring to FIG. 8. As noted earlier, the compressor shell can be made of two substantially semi-cylindrical shell halves joined at a substantially horizontal joint 14. One example of a shell half 12 is shown in FIG. 8. Each semi-cylindrical shell 12 can have a radially outer peripheral surface 27 and a radially inner peripheral surface 28. Further, each shell 12 can have two circumferential ends 70, which form the horizontal joint 14 for substantially mating engagement with the other shell half. Each shell 12 can have an axial upstream end 72 and an axial downstream end 74—"axial" referring to the axial direction of the compressor. The shell 12 can include a slot 26 extending along the radially inner peripheral surface 28 from one circumferential end 70 to the other circumferential end 70.

Figure 9B:
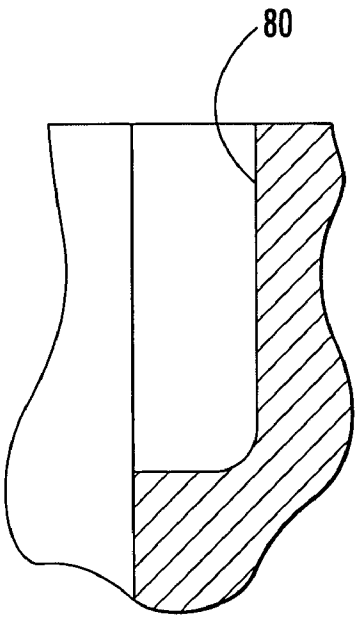
FIG. 9B is a side elevational view of a recess according to an embodiment of the invention, along view line 9B—9B in FIG. 9A.
Figure 9A:
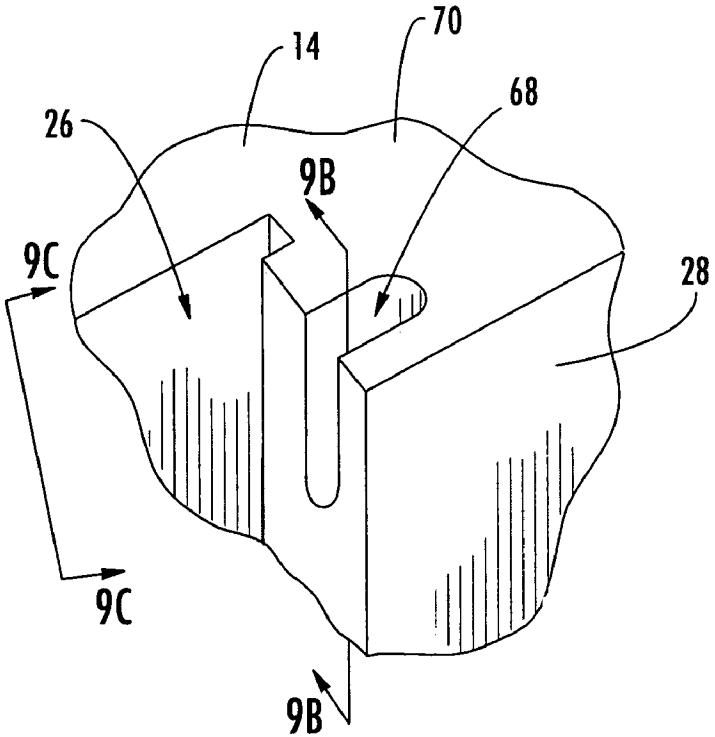
FIG. 9A is an isometric view of a compressor shell at the horizontal joint, taken at view FIG. 9A in FIG. 8, showing a recess according to aspects of the invention.
Figure 9C:
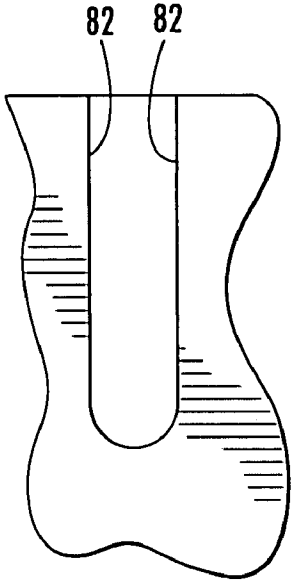
FIG. 9C is a cross-sectional view of a recess according to an embodiment of the invention, along view line 9C—9C in FIG. 9A.

With that background of the shell 12, the recess 68 will now be described. Again, the recess 68 receives the axial load applying member. At least one recess 68 can be provided substantially at one of the circumferential ends 70 of the compressor shell 12, such as shown in FIG. 9A. The recess 68 can extend substantially perpendicularly from the horizontal joint 14. It should be noted that the positioning of axial load applying members at or near the horizontal joint 14 is preferred for several reasons. First, the horizontal joint 14 is the area in which the outer shroud 24 can undergo the greatest range of motion. Second, experience has shown that the horizontal joint 14 is a frequent failure area. Third, the horizontal joint 14 provides a relatively easily accessible location for installation and other purposes.

Figure 4:
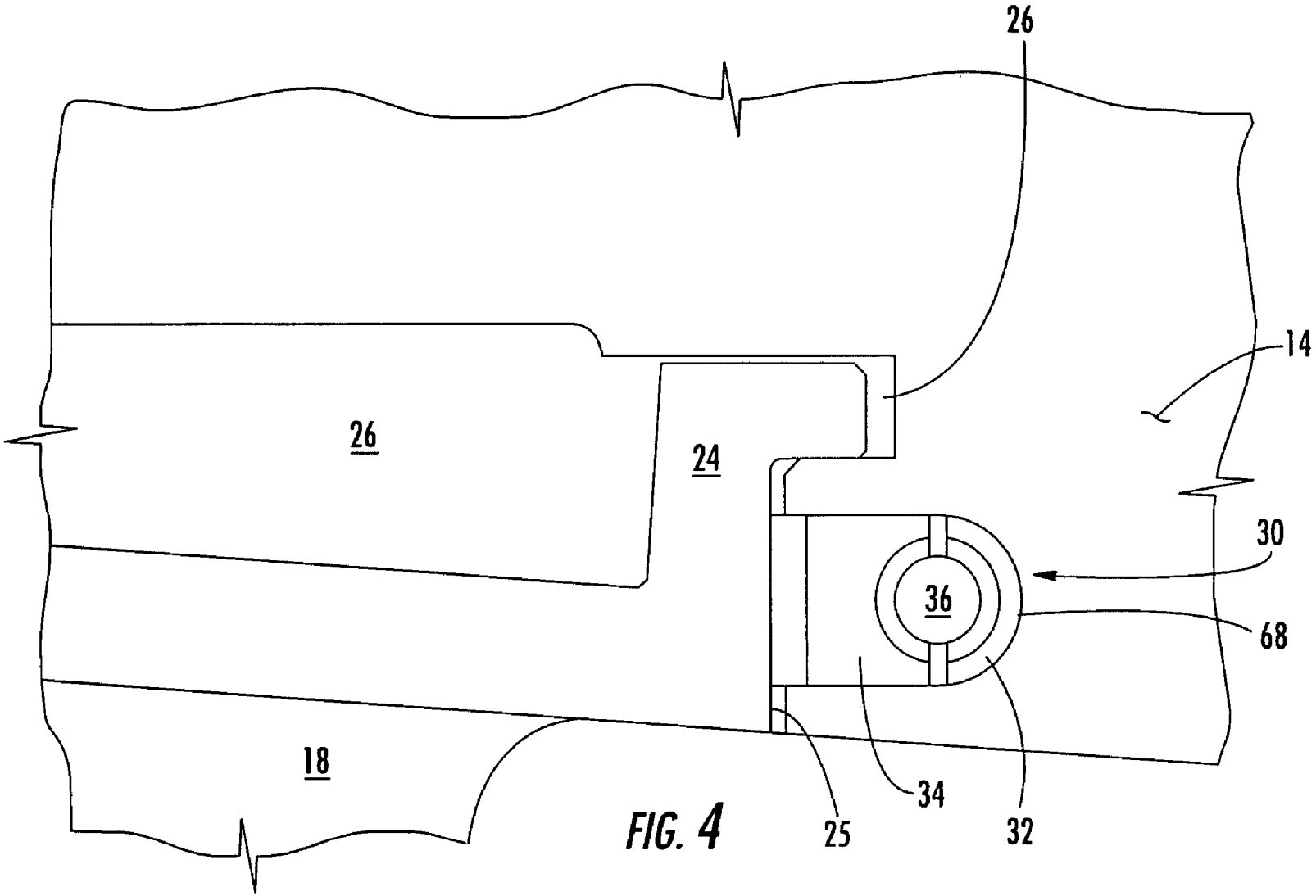
FIG. 4 is a close-up view of a compressor according to an embodiment of the invention, showing the compressor diaphragm interface with the slot in the compressor shell, taken at view FIG. 4 in FIG. 3.

The recess 68 can open into the slot 26 in the direction of one of the axial ends 72,74 of the shell 12. In one embodiment, the recess 68 can open into the slot 26 toward the upstream end 72 of the shell 12. As a result, the load applying member can exert an axial force on the aft face 25 of the outer shroud 24 in the axial upstream direction, as shown in FIG. 4. In another embodiment, the recess 68 can open into the slot 26 toward the downstream end 74 of the shell 12 such that the load applying member can exert an axial force on the forward face of the outer shroud 24 in the axial downstream direction.

The recess 68 can be made by any conventional machining process and can be included on newly manufactured compressor shells as well as existing compressor shells by field modification. The recess 68 itself can have any of a number of configurations. It can have a back wall 80 (FIG. 9B). Preferably, the back wall 80 of the recess 68 is shaped so as to substantially correspond to the outer surface of the axial load applying member, such as the outer face 38 of the first wedge block 32. Thus, the back wall 80 of the recess 68 can matingly engage and/or constrain the axial load applying member. Similarly, it is preferred if the side walls 82 of the recess 68, shown in FIG. 9C, substantially correspond to any associated sides of the axial load applying member so as to matingly engage and/or constrain the axial load applying member.

For each row of vanes, the number of recesses 68 that are needed depends on the number of axial load applying members employed. Ideally, for each compressor shell half 12, the axial load applying members can be provided in pairs at or near the horizontal joint 14, one at each of the circumferential ends 70. Thus, in one embodiment, there can be two axial load applying members, each positioned in a recess 68 formed at each circumferential end 70. In another embodiment, there can be a total of four axial load applying members associated with each diaphragm 20: two axial load members and associated recesses 68 for each half of the compressor shell 12. In yet another embodiment, there can be eight recesses provided, giving the option to choose which axial direction the axial load applying members exert their force. In some instances, however, the physical geometry of the slot 26 and/or the outer shroud 24 of the diaphragm 20 may dictate the position and orientation of the recess 68 because of a lack of room to provide a recess 68, for example.

In a preferred embodiment, the axial load applying members provide a force against the outer shroud 24 on the aft face 25 of the outer shroud 24 in the axially upstream direction 72. Providing the axial preload in this direction takes advantage of the gas load in the compressor 10 because the gas load is opposite to the direction of the gas flow. That is, a gas flowing through the compressor 10 is compressed, thereby increasing the pressure of the gas. As a result, the gas naturally seeks an area of lower pressure, which, in a compressor, will be axially upstream of a given point. Accordingly, the axially load applying member can cooperate with the gas load to apply an axial preload to the outer shroud 24.

For each diaphragm 20, it is also preferred if the axial load applying members, regardless of quantity, all exert their forces in the same direction; that is, the forces are either directed axially downstream 74 or axially upstream 72. However, in other rows, the forces may be exerted in the same or the opposite axial direction. For example, a first row diaphragm can be urged axially upstream, whereas the second row diaphragm can be urged axially downstream. In addition, the quantity and specific type of axial load applying members can vary from row to row in the same compressor. Further, the geometry and type of axial load applying members need not be identical in the same row.

Still other variations are possible. For example, the wedge pins 36, wedge blocks 32,34, and recess 68 can be of varying lengths at different rows of the compressor 10. In one embodiment, any of these components can have lengths ranging from about 1.5 inches to about 4.9 inches. The differing lengths may be needed for several reasons. For example, the contours of the inner peripheral surface 28 of the compressor shell 12 can vary. Further, as is known in the art, the ends of semi-circular diaphragms 20 may be cut at an angle. Thus, in some cases, a portion of an end of a first diaphragm 20, substantially residing in the slot 26 of a first compressor shell, can actually extend beyond the horizontal joint 14 of the first compressor shell 12 and protrude into the slot 26 of a second mating compressor shell. Thus, an axial load applying member and recess of the second compressor shell can be configured so as to avoid applying an axial load to the overextending portion of the first diaphragm, which may already have an axial load applied to it from its own axial load applying member in the first compressor shell.

Having described individual components according to embodiments of the invention, one manner of installing and using an axial loading member will now be described. It will be recognized that an axially loaded compressor diaphragm assembly can be formed in a number of ways depending on the particular loading member used. For purposes of this example, reference will be made to the multi-part wedge block apparatus 30, as described above. Beginning with the compressor shell 12 with slot 26 and recess 68, the diaphragm 20 can be slid into place. Once installed, the diaphragm 20 can be manually held into the axially upstream position, for example, to provide clearance. The first and second blocks 32,34 can be inserted into the recess 68, with the lower portions 44 first. If necessary, based on measurements or physical reality, a portion of the protrusion can be machined off to facilitate installation. Once installed, the top surfaces of the wedge blocks 32,34 can be substantially flush. When in the proper position, the top surfaces of the first and second blocks 32,34 can be at or, preferably, slightly below the horizontal joint surface 14.

Figure 10:
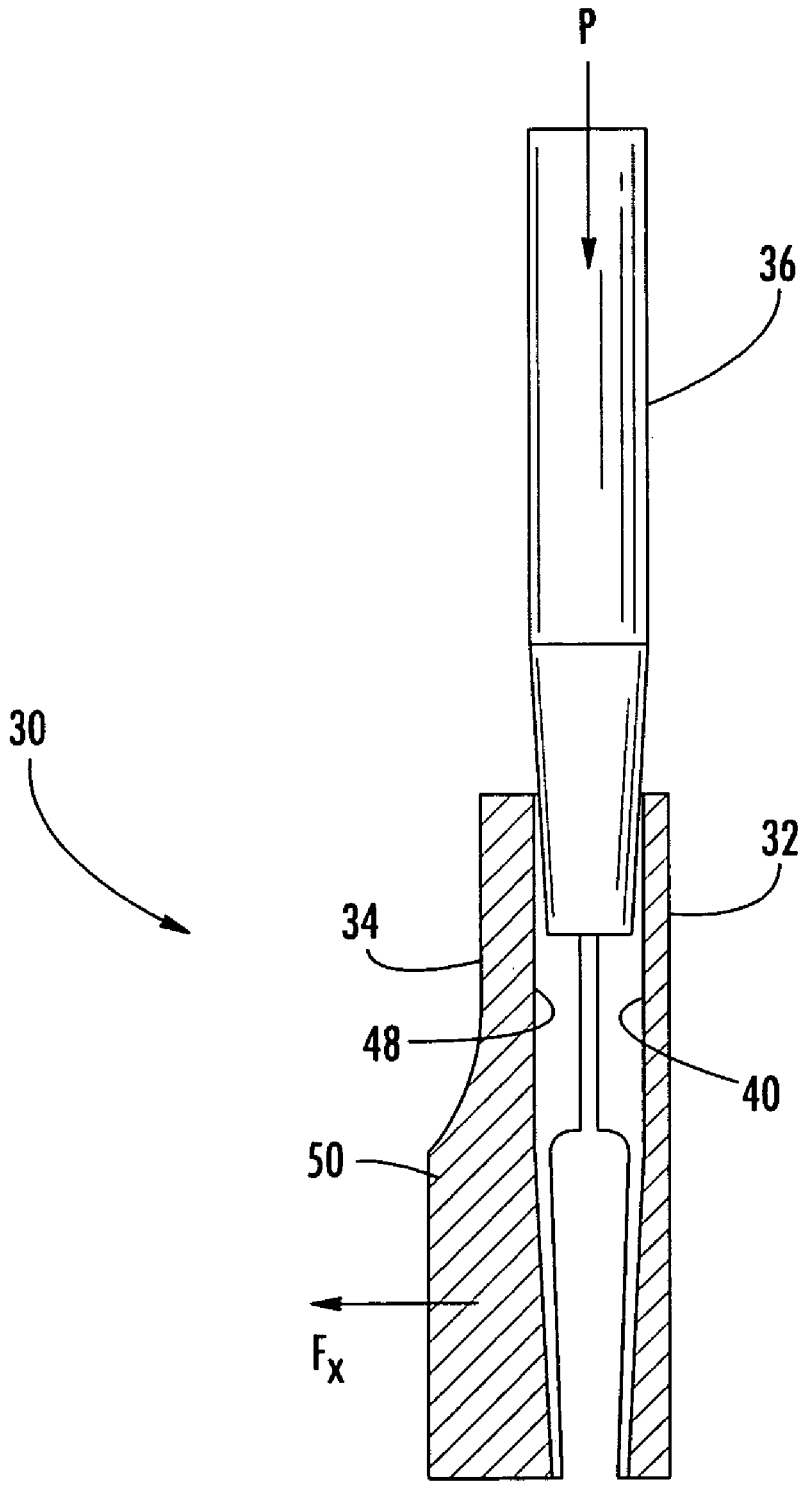
FIG. 10 is a side elevational view, partly in cross-section, showing the wedge pin being driven into the wedge block apparatus according to aspects of the invention.

Referring to FIG. 10, the wedge pin 36 can be inserted into the space between the inner faces 40,48 of the first and second wedge blocks 32,34. The wedge pin 36 can be forced downward by exposure to a force input P, such as by a hammer. Preferably, no lubricant is used on the wedge pin 36 and/or wedge blocks 32,34. The force P on the pin 36 can be converted to an axial load Fx by the spreading apart of the two wedge blocks 32,34. The pin load P is multiplied by mechanical advantage of the tapered sections of the pin 36 and the wedge blocks 32,34.

Again, the pin load P is converted into an axial load Fx on the wedge blocks 32,34; however, only the second wedge block 34 moves. As discussed above, the back and side walls 80,82 of the recess 68 can substantially constrain movement of the first or second wedge blocks 32,34 in those directions. Further, side loading of the wedge blocks 32,34 can be further minimized or prevented by the provision of the lateral cutaways 60 in the blocks 32,34. As noted earlier, the cutaways 60 need not extend all the way through to the outer faces 38,46 of the first and second wedge blocks 32,34, so long as pin 36 does not engage the inner faces 40,48 of the first and second wedge blocks 32,34 in these areas. As the second wedge block 34 moves axially outward, so too does the protrusion 50 on the second wedge block 34. Eventually, the protrusion 50 can directly engage the outer shroud 24 of the diaphragm 20.

Tapping the pin 36 can continue until all axial motion of the second wedge block 34 substantially ceases. At that point, the pin 36 can be staked into place by, for example, deforming the interface between the wedge pin 36 and the wedge blocks 32,34. Alternatively, the pin 36 can be welded to the wedge blocks 32,34 in at least two locations. Then, the pin 36 can be made substantially flush with the horizontal joint 14 by removing any excess length of the pin 36.

Similar procedures can be repeated at other locations. When both halves forming the compressor shell have the multi-part wedge block apparatus 30, then, when the halves are brought together, the ends of the pins 36 at the horizontal joints 14 can engage each other and can be substantially co-linear. Thus, not only are the pins 36 held in place by the self-holding taper and welds, but they are also prevented from backing out by the neighboring pin, thereby reducing the risk that the pins 36 will become unseated.

Instead of tapping the wedge pin 36 with a hammer to apply the force input P, a load block (not shown) can be affixed to the horizontal joint 14. A screw device (not shown) in the load block can be aligned above the wedge pin 36 and advanced to a specified torque value in order to provide a more accurate and controlled load P to the pin 36 and hence a more accurate and controlled load applied to the diaphragm outer shroud 24 by the wedge block apparatus 30. The screw device could also be tightened to a specified angle of turn, just past snug tight, in order to provide an even more accurate and controlled load P to the pin 36 and load Fx to the diaphragm outer shroud 24.

The expected loads on the system can be readily calculated by one skilled in the art. For instance, assuming a 3 degree taper angle and a coefficient of friction of about 0.10, the wedge load would be expected to be about 3.3 times the force input P on the pin 36. The axial force Fx would be also be about 3.3 times the pin load P.

Assuming the wedge pin 36 is made of stainless steel, the pin 36 could provide axial loads Fx of up to about 5000 pounds before the pin 36 itself yields. However, in order to maintain structural integrity of surrounding components, such as the outer shroud 24, the force Fx should be limited to a maximum of about 1000 pounds. Further, in some instances, less axial force Fx may be needed because, as noted earlier, the force of the wedge block works in tandem with the gas load of the compressor. It should be noted that the above load values are suitable for industrial gas turbine engines. However, these loads and limits are provided as an example, and aspects of the invention are not limited to these load values or limits. Indeed, other industrial gas turbine engines and other types of turbine engines and components may be able to tolerate forces greater or less than those set forth above. Accordingly, the force Fx can be adjusted as needed to meet application requirements.

The advancement of the second wedge block 34 relative to the advancement of the pin 36 can also be readily calculated. For example, assuming a 6 degree included self holding taper, then for every 0.05 inch increase in pin 36 engagement, the axial expansion of the second wedge block 34 is about 0.0052 inches. One skilled in the art will readily appreciate how to calculate the rate of advancement for other taper angles and other materials.

The foregoing description is provided in the context of one compressor system according to aspects of the invention. Of course, aspects of the invention can be employed with respect to myriad compressor designs, including all of those described above, as one skilled in the art would appreciate. Embodiments of the invention may have application to the turbine section of the engine in some instances. Thus, it will of course be understood that the invention is not limited to the specific details described herein, which are given by way of example only, and that various modifications and alterations are possible within the scope of the invention as defined in the following claims.

What is claimed is:

1. A system for reducing wear on a compressor diaphragm comprising:

a substantially semi-cylindrical compressor shell having a radially outer peripheral surface, a radially inner peripheral surface, two circumferential ends, an axial upstream end and an axial downstream end, wherein the shell includes a slot extending along the radially inner peripheral surface from one circumferential end to the other circumferential end, wherein the shell further includes at least one recess located substantially at one of the circumferential ends, the recess opening into the slot in the direction of one of the axial ends of the shell;

a diaphragm including an outer shroud with a plurality of airfoils extending radially therefrom, the outer shroud having a forward face and an aft face, wherein the outer shroud is received within the slot in the compressor shell; and a load applying member disposed within the recess, wherein the member exerts an axial force on one of the faces of the outer shroud in the direction of one of the axial ends of the shell.

2. The system of claim 1 wherein the circumferential ends are substantially horizontal.

3. The system of claim 1 wherein the recess opens into the slot toward the axial upstream end of the shell, whereby the load applying member exerts an axial force on the aft face of the outer shroud in the axial upstream direction.

4. The system of claim 1 wherein the recess opens into the slot toward the axial downstream end of the shell, whereby the load applying member exerts an axial force on the forward face of the outer shroud in the axial downstream direction.

5. The system of claim 1 wherein the load applying member is a wedge block.

6. The system of claim 1 wherein the wedge block includes an elongated first wedge block having an outer face and an inner face, each face extending along the length of the first wedge block, the inner face being substantially concave; and an elongated second wedge block having an outer face and an inner face, each face extending along the length of the second wedge block, the inner face being substantially concave, the second wedge block including a protrusion extending from the at least a portion of the outer face, wherein the first wedge block is positioned substantially adjacent to the second block such that the concave inner faces face each other, the concave inner faces tapering toward each other along a portion of the length of the first and second wedge blocks so as to define a tapered region, wherein at least one cutaway is formed in at least one of the inner faces along a portion of the length of at least one of the first and second wedge blocks.

7. The system of claim 6 wherein the recess is shaped to permit substantially only axial movement of the second wedge block.

8. The system of claim 6 wherein the tapered region is a self-holding taper.

9. The system of claim 6 further including a wedge pin, the pin including an upper region transitioning to a tapered region, wherein the pin is lockingly received between the first and second wedge blocks when the tapered region of the pin engages the tapered region of the first and second wedge blocks.

10. A wedge block apparatus for applying an axial preload on a compressor diaphragm comprising:

an elongated first wedge block having an outer face and an inner face, each face extending along the length of the first wedge block, the inner face being substantially concave; and an elongated second wedge block having an outer face and an inner face, each face extending along the length of the second wedge block, the inner face being substantially concave, the second wedge block including a protrusion extending from at least a portion of the outer face, wherein the first wedge block is positioned substantially adjacent to the second block such that the concave inner faces face each other, the concave inner faces tapering toward each other along a portion of the length of the first and second wedge blocks so as to define a tapered region, wherein at least one cutaway is formed in at least one of the inner faces along a portion of the length of at least one of the first and second wedge blocks.

11. The wedge block apparatus of claim 10 wherein the cutaway is formed substantially in the tapered region.

12. The wedge block apparatus of claim 10 wherein the first and second wedge blocks define first and second sidewalls, the cutaways being formed in the sidewalls substantially in the tapered region.

13. The wedge block apparatus of claim 10 wherein the tapered region is a self-holding taper.

14. The wedge block apparatus of claim 13 wherein the self-holding taper is no more than about 6 degrees included.

15. The wedge block apparatus of claim 13 wherein the self-holding taper is at least about 6 degrees included.

16. The wedge block apparatus of claim 10 further including a pin, the pin including an upper region transitioning to a tapered region, wherein the pin is lockingly received between the first and second wedge blocks when the tapered region of the pin engages the tapered region of the first and second wedge blocks, whereby, as the pin is driven in between the first and second blocks, the cutaway substantially prevents transmission of the pin load to cause lateral movement of the first and second wedge blocks.

17. The wedge block apparatus of claim 16 wherein the tapered region of the pin is a self-holding taper.

18. The wedge block apparatus of claim 17 wherein the self-holding taper is no more than about 6 degrees included.

19. A method of reducing wear on a compressor diaphragm comprising the steps of:

providing a substantially semi-cylindrical compressor shell having a radially outer peripheral surface, a radially inner peripheral surface, two circumferential ends, an axial upstream end and an axial downstream end, wherein the shell includes a slot extending along the radially inner peripheral surface from one circumferential end to the other circumferential end, wherein the shell further includes at least one recess located substantially at one of the circumferential ends;

providing a diaphragm including an outer shroud with a plurality of airfoils extending radially therefrom, the outer shroud having a forward face and an aft face, wherein the outer shroud is received within the slot in the compressor shell; and applying a substantially axial force on one of the faces of the outer shroud in the direction of one of the axial ends of the shell, wherein the force is applied substantially at the horizontal joint at each circumferential end of the compressor shell.

20. The method of claim 19 wherein the step of applying a substantially axial force includes the steps of:

providing at least one recess in the shell located substantially at one of the circumferential ends, wherein the recess opens into the slot in the direction of one of the axial ends of the shell; and inserting an axial load applying member in the slot such that the member applies an axial load on the outer shroud of the diaphragm.

* * * * *